US005820732A

United States Patent [19]

Gregersen et al.

[11] Patent Number: 5,820,732

[45] Date of Patent: Oct. 13, 1998

[54] CLEANING APPARATUS FOR CLEANING A FORMING WIRE

[75] Inventors: Matthew L. Gregersen, Rockton, Ill.; Paul Newton; David E. Oldenburg, both of Beloit, Wis.; Jeffrey H. Pulkowski, Roscoe, Ill.; Jay Shands, Beloit, Wis.

[73] Assignee: Beloit Technologies, Inc., Wilmington, Del.

[21] Appl. No.: 880,659

[22] Filed: Jun. 23, 1997

[51] Int. Cl.[6] ..... D21F 1/32

[52] U.S. Cl. ..... 162/275; 162/199; 162/272

[58] Field of Search ..... 162/199, 272, 162/275, 276, 279, 264; 15/302, 309.1; 134/198

*Primary Examiner*—Peter Chin
*Assistant Examiner*—Steven B. Leavitt
*Attorney, Agent, or Firm*—Dirk J. Veneman; Raymond W. Campbell; David J. Archer

[57] ABSTRACT

A cleaning apparatus is disclosed for cleaning a forming wire extending around a wire turning roll of a paper machine. The apparatus includes a shower which is disposed upstream relative to the turning roll for spraying a cleaning liquid onto the forming wire. A housing is disposed between the shower and the turning roll, the housing being connected to a source of pressurized air. The housing defines an opening which has a first and a second end. The housing also defines an orifice which has an upstream and a downstream end for permitting a flow therethrough of the pressurized air such that the flow of air is directed against the wire for at least partially removing the cleaning liquid therefrom. The opening cooperates with the turning roll such that the opening conforms with the turning roll for substantially sealing the opening against loss of the pressurized air so that the flow of pressurized air is directed through the orifice.

12 Claims, 2 Drawing Sheets

CLEANING APPARATUS FOR CLEANING A FORMING WIRE

BACKGROUND OF THE INVENTION

1. Field of the Invention

The present invention relates to a cleaning apparatus for cleaning a forming wire.

More specifically, the present invention relates to a cleaning apparatus for cleaning a forming wire which extends around a wire turning roll in a forming section of a paper machine.

2. Information Disclosure Statement

In the papermaking art, paper stock is ejected from a headbox onto a forming wire such that water within the stock is drained through the forming wire leaving behind a formed web on the moving forming wire.

Subsequently, the formed web is removed from the forming wire and is guided through a press section for pressing most of the water out of the web in order to provide a pressed sheet of paper.

Additionally, the pressed sheet is guided through a drying section for drying the pressed web.

However, in the forming section, there is a tendency for the forming wire to become clogged with fines and other extraneous materials. The aforementioned fines are added to the paper stock in order to enhance the resultant characteristics of the formed web.

Consequently, it is necessary to remove such fines from the forming wire in order to maintain the quality of the resultant paper web.

In the prior art, various cleaning apparatus have been proposed which include spraying water onto the forming wire and subsequently removing such water together with the fines and other contaminants from the forming wire by means of air jets.

The present invention provides an improved arrangement for cleaning a forming wire by utilizing the interaction of a housing connected to a source of air pressure and a forming wire turning roll.

Therefore, it is the primary objective of the present invention to provide a wire cleaning apparatus that overcomes the problems associated with the prior art arrangements and which provides a significant contribution to the art of cleaning a forming wire of a papermaking machine.

Other objects and advantages of the present invention will be readily apparent to those skilled in the art by consideration of the detailed description contained hereinafter taken in conjunction with the annexed drawings.

SUMMARY OF THE INVENTION

The present invention relates to a cleaning apparatus for cleaning a forming wire extending around a wire turning roll of a paper machine.

The apparatus includes a shower which is disposed upstream relative to the turning roll for spraying a cleaning liquid onto the forming wire.

A housing is disposed between the shower and the turning roll the housing being connected to a source of pressurized air. The housing defines an opening having a first and second end. The housing also defines an orifice means which has an upstream and a downstream end for permitting a flow therethrough of the pressurized air such that the flow is directed against the wire for at least partially removing the cleaning liquid therefrom.

The opening cooperates with the turning roll such that the opening conforms with the turning roll for substantially sealing the opening against loss of the pressurized air so that the flow of pressurized air is directed through the orifice means.

In a more specific embodiment of the present invention, the shower is disposed adjacent to the upstream end of the orifice means.

Also, the shower is disposed on the same side of the forming wire as the housing.

Furthermore, the cleaning liquid is water.

Additionally, the housing is a wedge shaped box which extends in a cross-machine direction along the entire width of the forming wire.

More specifically, the second end of the opening is disposed adjacent to a converging nip defined between the turning roll and the forming wire and the first end of the opening is disposed adjacent to the turning roll.

The orifice means extends substantially from the shower to the second end of the opening and includes a plate which extends in a cross-machine direction across the entire width of the forming wire. The plate in one embodiment of the present invention defines a plurality of equally spaced holes for the flow therethrough of the pressurized air.

In an alternative embodiment of the present invention, the orifice means includes a plate which extends in a cross-machine direction across the entire width of the forming wire, such plate defining a plurality of slots for the flow therethrough of the pressurized air.

In both embodiments of the present invention, the orifice means is disposed closely adjacent to the forming wire and extends between the shower and the converging nip defined between the turning roll and the forming wire.

More specifically, the opening is arc-shaped for cooperating with a portion of a circumferential surface of the turning roll. The arrangement is such that when the housing is disposed closely adjacent to the turning roll with the second end of the opening disposed at the converging nip defined by the turning roll and the forming wire, the opening and the turning roll cooperate with each other for inhibiting any loss of the pressurized air through the opening.

Many modifications and variations of the present invention will be readily apparent to those skilled in the art by consideration of the detailed description contained hereinafter.

However, such modifications and variations fall within the spirit and scope of the present invention as defined by the appended claims.

BRIEF DESCRIPTION OF THE DRAWINGS

Similar reference characters refer to similar parts throughout the various embodiments shown in the drawings.

DETAILED DESCRIPTION OF THE DRAWINGS

Figure 1:
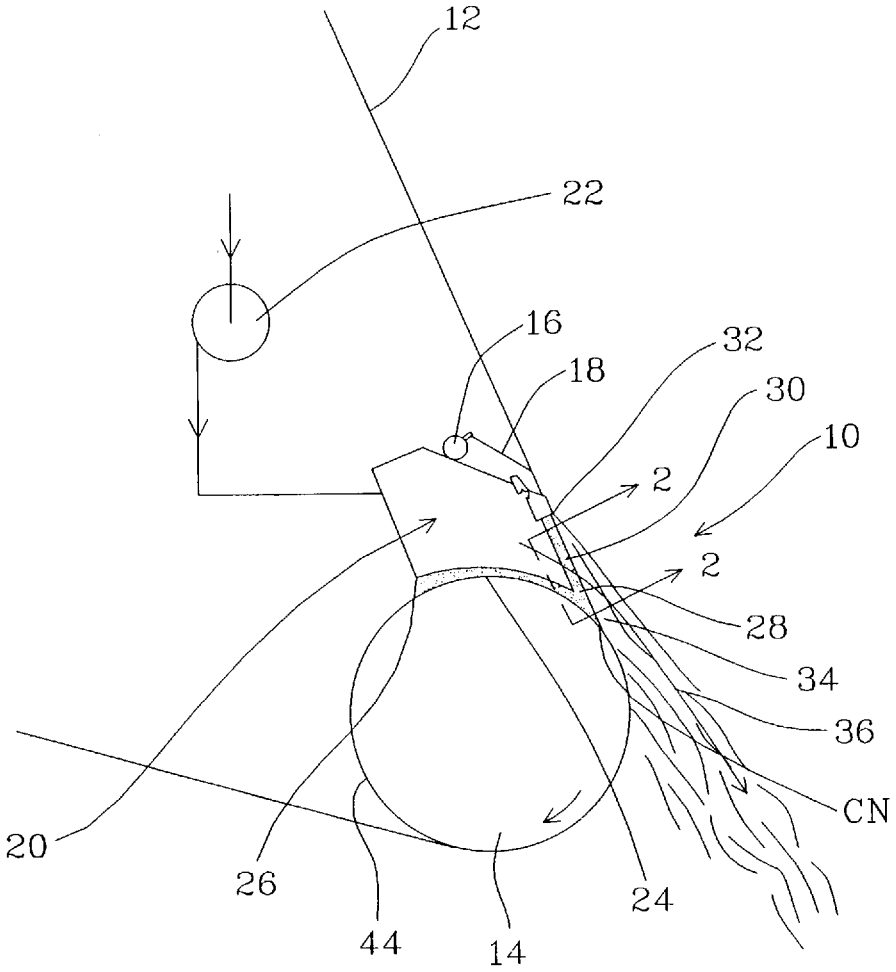
FIG. 1 is a side elevational view of a cleaning apparatus according to the present invention.

FIG. 1 is a side-elevational view of a cleaning apparatus generally designated 10 according to the present invention for cleaning a forming wire 12 extending around a wire turning roll 14 of a paper machine.

The apparatus includes a shower 16 which is disposed upstream relative to the turning roll 14 for spraying a cleaning liquid onto the forming wire 12.

A housing generally designated 20 is disposed between the shower 16 and the turning roll 14 with the housing 20 being connected to a source of pressurized air 22. The housing 20 defines an opening 24 having a first and a second end 26, 28, respectively. Additionally, the housing 20 defines an orifice means 30 having an upstream and a downstream end 32, 34, respectively. The orifice means 30 permits a flow therethrough as indicated by the arrow 36 of the pressurized air such that the flow 36 is directed against the wire 12 for at least partially removing the cleaning liquid 18 therefrom together with any contaminants therein.

The opening 24 cooperates with the turning roll 14 such that the opening 24 conforms with the turning roll 14 for substantially sealing the opening 24 against any loss of the pressurized air so that the flow 36 of pressurized air is directed exclusively through the orifice means 30.

As shown in FIG. 1, the shower 16 is disposed adjacent to the upstream end 32 of the orifice means 30 and is disposed on the same side of the forming wire 12 as the housing 20.

Preferably, the cleaning liquid 18 is water and the housing 20 is a wedge-shaped box which extends in a cross-machine direction along the entire width of the forming wire 12.

The second end 28 of the opening 24 is disposed adjacent to a converging nip CN which is defined between the turning roll 14 and the forming wire 12.

The first end 26 of the opening 24 is disposed adjacent to the turning roll 14 and the orifice means 30 extends substantially from the shower 16 to the second end 28 of the opening 24.

Figure 2:
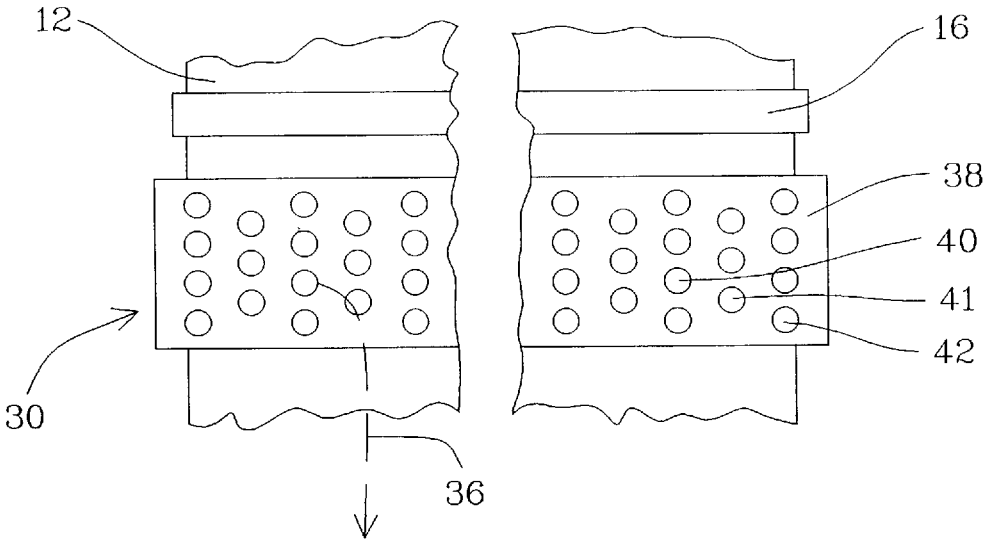
FIG. 2 is an enlarged sectional view taken on the line 2—2 of FIG. 1.

More specifically and as shown in FIG. 2 which is an enlarged sectional view taken on the line 2—2 of FIG. 1, the orifice means 30 includes a plate 38 which extends in a cross-machine direction across the entire width of the forming wire 12. The plate 38 defines a plurality of equally spaced holes 40, 41, 42 for the flow therethrough 36 of the pressurized air.

Figure 3:
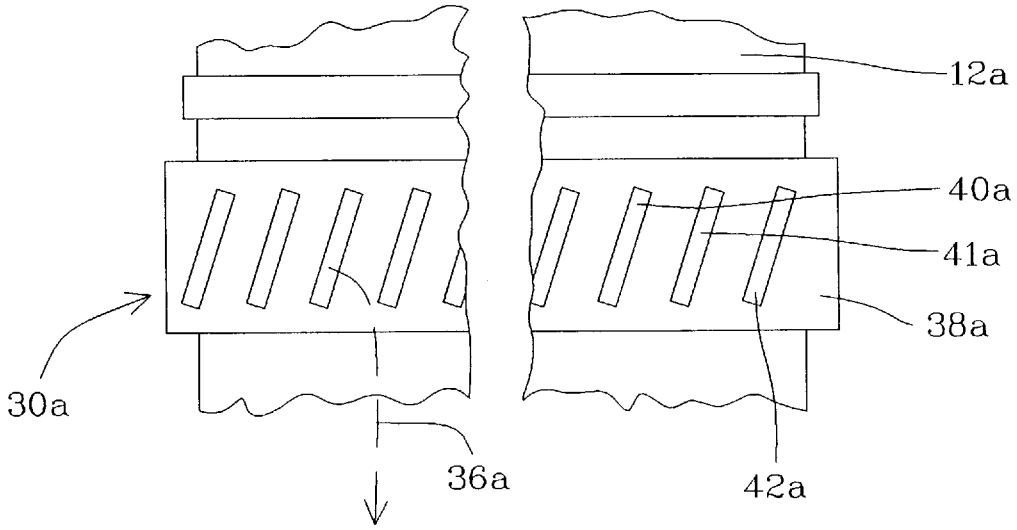
FIG. 3 is a similar view to that shown in FIG. 2 but shows an alternative embodiment of the present invention.

FIG. 3 is a similar view of that shown in FIG. 2 but shows an alternative embodiment of the present invention in which the orifice means 30A includes a plate 38A which extends in a cross-machine direction across the entire width of the forming wire 12A. The plate 38A defines a plurality of slots 40A, 41A, 42A for the flow therethrough 36A of the pressurized air.

The orifice means 30 in both embodiments is disposed closely adjacent to the forming wire 12 and extends between the shower 16 and the converging nip CN defined between the turning roll 14 and the forming wire 12.

As shown in the drawings, the opening 24 is arc-shaped for cooperating with a portion of the circumferential surface 44 of the turning roll 14 such that when the housing 20 is disposed closely adjacent to the turning roll 14 with the second end 28 of the opening 24 disposed at the converging nip CN defined between the turning roll 14 and the forming wire 12, the opening 24 and the turning roll 14 cooperate together to inhibit any loss of the pressurized air through the opening 24.

The present invention provides an arrangement in which air 36 is forced through the forming fabric 12 by the pressure in the housing 20 together with the additional pressure created by the rotation of the turning roll 14 and the converging nip CN between the turning roll 14 and the forming wire 12. The shower 16 is located ahead of the housing 20 in order to saturate the forming wire 12 with water.

The advantage of the present invention over a prior art box using a slotted cover is that the pressure pulse created by the converging nip between the roll and the fabric is utilized. Also, potentially, less pressure is required to achieve the same degree of fabric cleanliness.

Additionally, a mist on the shower side of the fabric or forming wire will be more contained which is beneficial for the cleaning operation.

What is claimed is:

1. A cleaning apparatus for cleaning a forming wire extending around a wire turning roll of a paper machine, said apparatus comprising:

a shower disposed upstream relative to the turning roll for spraying a cleaning liquid onto the forming wire;

a housing disposed between said shower and the turning roll, said housing being connected to a source of pressurized air, said housing defining an opening having a first and a second end, said housing also defining an orifice means having an upstream and a downstream end for permitting a flow therethrough of the pressurized air such that said flow is directed against the wire for at least partially removing the cleaning liquid therefrom; and said opening cooperating with the turning roll such that said opening conforms with the turning roll for substantially sealing said opening against loss of the pressurized air so that said flow of pressurized air is directed through said orifice means.

2. A cleaning apparatus as set forth in claim 1 wherein said shower is disposed adjacent to said upstream end of said orifice means.

3. A cleaning apparatus as set forth in claim 1 wherein said shower is disposed on the same side of the forming wire as said housing.

4. A cleaning apparatus as set forth in claim 1 wherein said cleaning liquid is water.

5. A cleaning apparatus as set forth in claim 1 wherein said housing is a wedge shaped box extending in a cross-machine direction along an entire width of the forming wire.

6. A cleaning apparatus as set forth in claim 1 wherein said second end of said opening is disposed adjacent to a converging nip defined between the turning roll and the forming wire.

7. A cleaning apparatus as set forth in claim 1 wherein said first end of said opening is disposed adjacent to the turning roll.

8. A cleaning apparatus as set forth in claim 1 wherein said orifice means extends substantially from said shower to said second end of said opening.

9. A cleaning apparatus as set forth in claim 1 wherein said orifice means includes:

a plate extending in a cross machine direction across an entire width of the forming wire, said plate defining a plurality of equally spaced holes for said flow therethrough of the pressurized air.

10. A cleaning apparatus as set forth in claim 1 wherein said orifice means includes:

a plate extending in a cross machine direction across an entire width of the forming wire, said plate defining a plurality of slots for said flow therethrough of the pressurized air.

11. A cleaning apparatus as set forth in claim 1 wherein said orifice means is disposed closely adjacent to the forming wire, said orifice means extending between said shower and a converging nip defined between the turning roll and the forming wire.

12. A cleaning apparatus as set forth in claim 1 wherein said opening is arc shaped for cooperating with a portion of a circumferential surface of the turning roll such that when said housing is disposed closely adjacent to the turning roll with the second end of said opening disposed adjacent to a converging nip defined between the turning roll and the forming wire, said opening and the turning roll cooperate with each other for inhibiting any loss of the pressurized air through said opening.

* * * * *